United States Patent [19]

Drimmer

[11] 3,995,574

[45] Dec. 7, 1976

[54] DYNAMIC METHOD FOR ENHANCING EFFECTS OF UNDERWATER EXPLOSIONS

[76] Inventor: Bernard E. Drimmer, 4841 S. 9th St., Arlington, Va. 22204

[22] Filed: July 29, 1974

[21] Appl. No.: 494,010

[52] U.S. Cl. ..... 114/20 R; 102/24 HC; 102/54; 102/56 SC; 102/70.2 P; 102/DIG. 2

[51] Int. Cl.[2] ..... F42B 19/00

[58] Field of Search ..... 102/54, 24 HC, 56 SC, 102/70.2 P, DIG. 2; 114/20 R

[56] References Cited

UNITED STATES PATENTS

| | | | |
|---|---|---|---|
| 3,136,251 | 6/1964 | Witow | 102/70.2 P |
| 3,280,743 | 10/1966 | Reuther | 102/DIG. 2 |
| 3,661,088 | 5/1972 | Harr et al. | 102/DIG. 2 |
| 3,703,865 | 11/1972 | Gilbertson et al. | 102/DIG. 2 |
| 3,714,897 | 2/1973 | Parker | 102/DIG. 2 |
| 3,877,376 | 4/1975 | Kupelian | 102/DIG. 2 |

*Primary Examiner*—Verlin R. Pendegrass
*Attorney, Agent, or Firm*—R. Sciascia; R. Beers; S. Sheinbein

[57] ABSTRACT

Means for directing and enhancing the explosive energy of a torpedo in a preferred direction comprising a shaped charge with a concave liner, which may be spheroidal, a peripheral ring of spaced detonators at the rear of the charge, a ring of spaced sensors at the front end of the torpedo and connections from each sensor to the detonator which it activates, the detonator being located on its ring diametrically opposite its associated sensor on its ring. Activation of the sensor causes its partner detonator to initiate detonation of the main charge, the resulting shaped charge jet forming a cavity in the water oriented toward the target which activated the sensor. Before this water cavity has time to collapse, its presence causes a disproportionately high amount of explosive energy to move in the direction of the cavity, viz toward the target, enhancing the damage-producing effect of the explosive charge.

9 Claims, 3 Drawing Figures

DYNAMIC METHOD FOR ENHANCING EFFECTS OF UNDERWATER EXPLOSIONS

STATEMENT OF GOVERNMENT INTEREST

The invention described herein may be manufactured and used by or for the Government of the United States of America for governmental purposes without the payment of any royalities thereon or therefor.

BACKGROUND OF THE INVENTION

This invention relates to underwater explosions and especially to a means for directing and enhancing the force of an underwater torpedo explosion in a preferred direction.

In an underwater explosion, such as that produced by a torpedo, the explosive energy is distributed more or less uniformily around the position of the warhead, with most of the energy directed away from the target. It would be desirable to be able to direct more of the force of the explosion toward the target, enhancing its target-damage potential.

Accordingly, an object of this invention is to direct the force of an underwater missile explosion in a preferred direction.

Another object is to enhance the force of an underwater missile explosion in a preferred direction.

Other objects, advantages, and novel features of the present invention will become apparent from the following detailed description of the invention when considered in conjunction with the accompanying drawings.

SUMMARY OF THE INVENTION

The invention comprises a shaped charge bearing a peripheral ring of spaced detonators at its rear end. At its front end, the charge has a concavely curved liner. Spaced from this liner is a ring of spaced sensors, the sensors being located on their ring in one-to-one correspondence with the detonators on their ring. The axis of the detonator ring, the axis of revolution of the curved liner and the axis of the sensor ring are coincident. Each sensor is connected to activate, upon sensing a predetermined condition, a different detonator, the sensor and its associated detonator being mounted on diametrically opposite points on their rings. Initiation of an individual detonator causes detonation of the main explosive charge, which in turn collapses the shaped-charge liner, giving rise to a shaped-charge jet. The jet travels along the path essentially defined by the extension of the shortest line connecting the detonator with the surface of the shaped-charge liner. The jet forms a cavity in the water which, before it has time to collapse, causes extra explosive energy to move toward the region of the water cavity, i.e. toward the target physically located near the activating sensor. The explosive force is thus "focused" by the liner along a line going from the activated detonator through the detonator-activating sensor, or somewhere near this sensor.

DETAILED DESCRIPTION OF THE INVENTION

Figure 1:
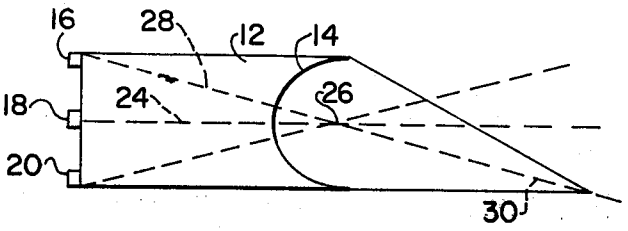
FIG. 1 is a side view in schematic for of a shaped charge, indicating how the explosive force is directed.

FIG. 1 illustrates schematically the directional effect of the invention in the explosion of a shaped charge 12. The shaped charge 12 has a liner 14, which is curved concavely at is front end. The charge 12 shown is cylindrical to fit into a cylindrical torpedo casing 22 and around its periphery at the rear are mounted a number of detonators of which only three, 16, 18 and 20, are shown.

If detonator 18 is activated, by any convenient means, the explosive force will first reach the liner 14 along a line which extends from the detonator 18 to the liner and is the shortest line from the detonator to the liner. (With a hemispherically curved liner the shortest line is always perpendicular to the liner.) This line will be line 24 and it passes through the focal point 26 of the liner 14 if the liner is hemispherically curved. If the detonator 16 is activated, the explosive force reaches the liner 14 first along line 28. The explosive force propagating through the liner forms a jet 30 which is a thin pencil, or thread, of liner material which penetrates the torpedo casing and passes through the water forming a cavity behind it. Much of the explosive energy is directed along the line taken by the jet 30 so that the explosive effect is enhanced in the direction defined by the path of the jet 30. The off-axis initiation by one of the detonators causes the jet, and resultant cavity, to be more directly disposed toward the target than would occur if the charge were initiated at the central point of the initiator ring. Thus the enhancement effect will be superior to the normal enhancement effect obtained by initiation of a shaped charge at the center of the initiator ring.

Figure 2:
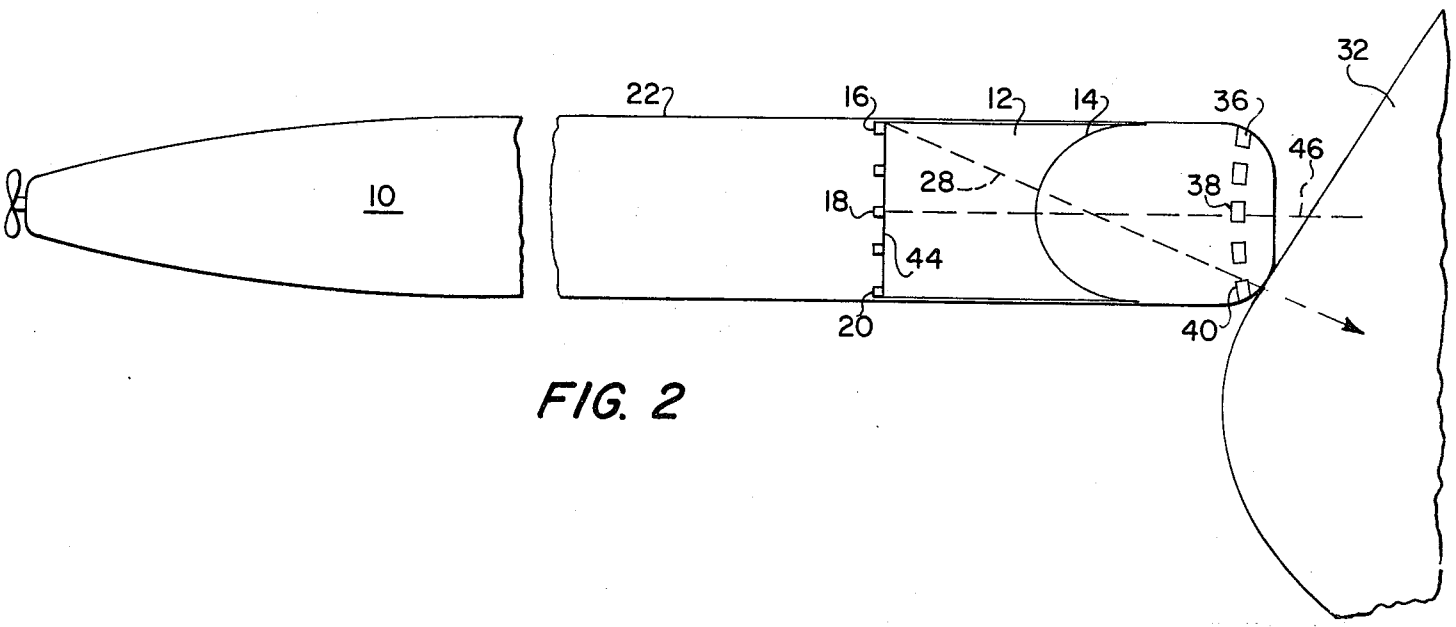
FIG. 2 is a view of a torpedo embodying the invention striking a ship at a glancing angle.
Figure 3:
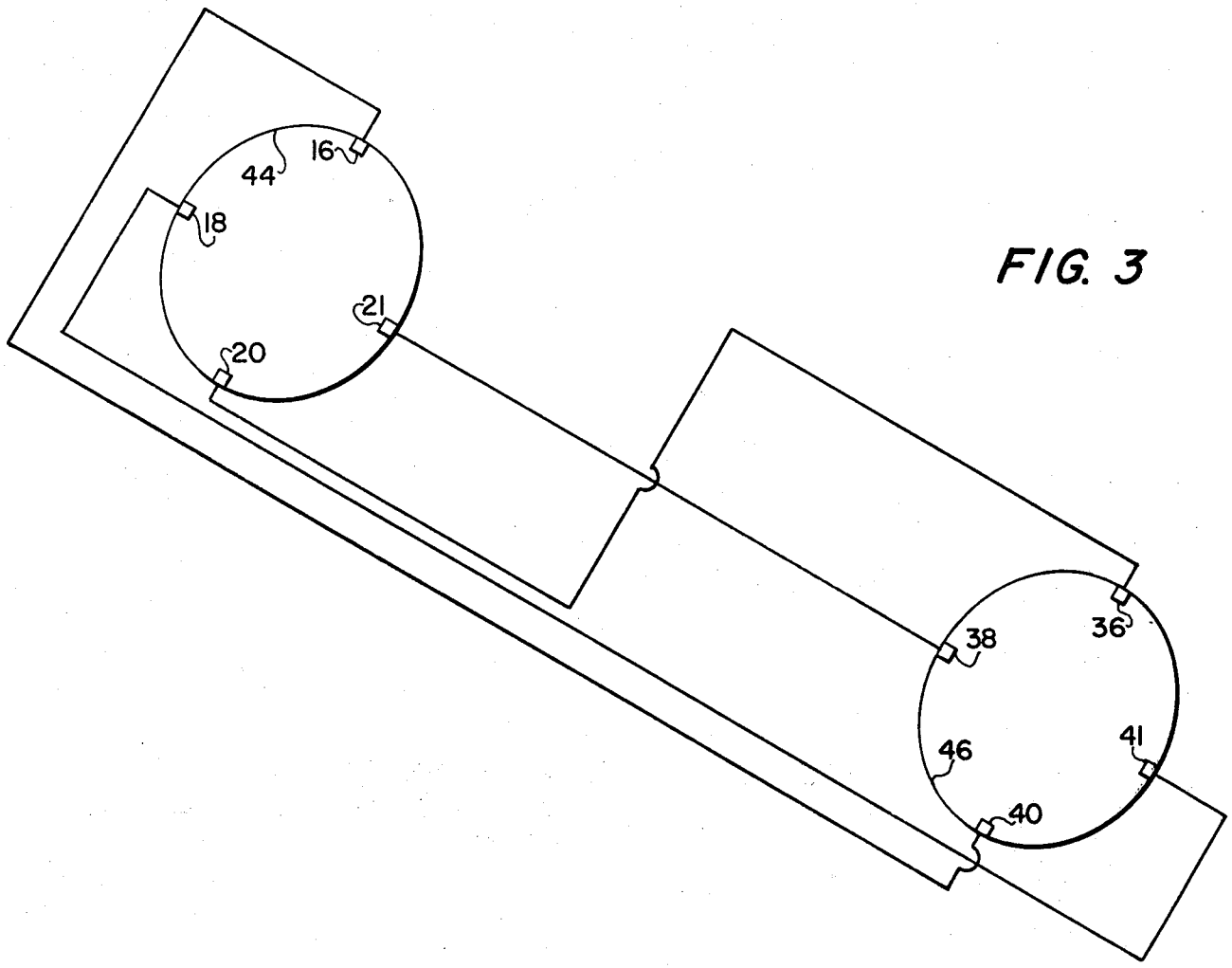
FIG. 3 is a connection diagram showing the connections from the sensors to the detonators.

FIG. 2 shows the operation of the invention when a torpedo hits a ship 32 (only a portion of the hull is shown) at a glancing angle. A plurality of sensors, only some of which 36–40 are shown, are mounted in a ring at the front of the torpedo 10. There are the same number of sensors as there are detonators. The sensors may be piezoelectric transducers which deliver an electric pulse to the detonators when they strike an object. Of course, the sensors may also be other types of sensors such as proximity detectors, if it is desired to explode the charge some distance away from the target. If the detonators and sensors are thought of as mounted along peripheral rings 44 and 46, respectively, then each sensor is wired to the detonator which is located diametrically opposite to it on the respective rings. FIG. 3 shows schematically the periphery 44 of the shaped charge with four detonators, 16, 18, 20 and 21, arranged symmetrically around it and the ring 46 around the torpedo casing in which the sensors, 36, 38, 40 and 41, are mounted. The detonator 16 is wired to its diametrically opposite sensor 40, detonator 18 to sensor 41, detonator 20 to sensor 36 and detonator 21 to sensor 38. In practice, more detonators and sensors would be employed.

The sectional curve seen when a slice is made by a plane through the shaped-charge liner 14, which is the curve seen in FIG. 1, may be taken from any of the conic section curves — circle, parabola, ellipse, hyperbola — but the preferred curves are the circle and the parabola, or curves substantially similar to the circle or parabola; these curves may be designated spheroidal or paraboloidal curves. A liner whose sectional curve corresponds to any of the conic-section curves will provide some directionality but the best directionality is provided by the circle (spheroidal liner). Curves having curvatures lying between the circle and parabola also provide adequate directivity, and the term "cirboloid" (adjective "cirbolic") will be used to include sectional curves which are parts of a circle, parabola, or curves lying with the curvatures limited by the circle and parabola. It can be seen from FIG. 2 that the axes of the sensor and detonator rings and the axis of revolution of the cirboloid are all coincident and are represented by line 24.

Obviously, many modifications and variations of the present invention are possible in light of the above teachings. It is therefore to be understood that, within the scope of the appended claims, the invention may be practiced otherwise than as specifically described.

What is claimed is:

1. An energy-directing system for a shaped charge comprising, in combination:

a plurality of spaced sensors in the form of a ring, the ring being located in a first plane:

a plurality of spaced detonators in the form of a ring, the ring being located in a second plane which is spaced from the first; the detonators being correspondingly located with the sensors on their respective rings;

a shaped charge having two ends and a concave liner in the shape of a cirboloid at one end, said ring of detonators being located at its other end, the cirboloid end being nearer the sensor ring, said rings being coaxial and the axis of revolution of said cirboloid being coincident with the axes of said rings; and means connecting said detonators to said sensors for activating said detonators upon the occurrence of a predetermined condition, each sensor being connected to that detonator which is diametricallly opposite it relative to their respective rings.

2. A system as in claim 1, wherein said sensors are piezoelectric transducers.

3. A system as in claim 1, wherein said cirboloid is a circle.

4. A system as in claim 1, wherein said cirboloid is a parabola.

5. Means for directing in a preferred direction the explosive energy of a missile having a torpedo-like cylindrical casing for enclosing an explosive cylindrical charge comprising, in combination:

a shaped charge having a liner at its front end, said liner being concave and having a sectional curve in the shape of a cirboloid, said shaped charge being adapted for enclosure within a cylindrical torpedo-like casing with the liner facing the front end of the casing;

a plurality of detonators spaced from each other and mounted at the rear of the shaped charge in the form of a peripheral ring; and a plurality of sensors, each capable of sensing the occurrence of a predetermined condition and thereupon activating one of said detonators, said sensors being spaced from each other and mounted to form a ring with the sensors being located in the same positions along their ring as the detonators are along their rings, each sensor being connected to activate that detonator which is located in a position diametrically opposite its own position.

6. Means as in claim 5, wherein said sensors are mounted near the front end of said casing.

7. Means as in claim 5, wherein said sensors are piezoelectric transducers.

8. Means as in claim 5, wherein said cirboloid is a circle.

9. Means as in claim 5, wherein said cirboloid is a parabola.

* * * * *